United States Patent [19]

Boda

[11] Patent Number: 4,805,482

[45] Date of Patent: Feb. 21, 1989

[54] CAM ADJUSTMENT ASSEMBLY

[75] Inventor: James C. Boda, Winneconne, Wis.

[73] Assignee: Brunswick Corporation, Skokie, Ill.

[21] Appl. No.: 88,844

[22] Filed: Aug. 24, 1987

[51] Int. Cl.[4] ..... G05G 1/04

[52] U.S. Cl. ..... 74/571 M; 74/522

[58] Field of Search ..... 74/568, 571 M, 522, 74/525

[56] References Cited

U.S. PATENT DOCUMENTS

| | | | |
|---|---|---|---|
| 2,112,890 | 4/1938 | Gunn | 74/571 R |
| 3,952,611 | 4/1976 | Cumming | 74/522 |
| 4,224,012 | 9/1980 | White | 74/571 M |
| 4,538,336 | 9/1985 | Oliver | 74/571 M |
| 4,616,518 | 10/1986 | Nusser | 74/571 M |
| 4,648,758 | 3/1987 | Itzov | 74/522 |
| 4,656,887 | 4/1987 | Yoshida | 74/522 |

FOREIGN PATENT DOCUMENTS

| | | | |
|---|---|---|---|
| 491875 | 9/1938 | United Kingdom | 74/525 |

*Primary Examiner*—Richard E. Moore
*Assistant Examiner*—Vinh Luong
*Attorney, Agent, or Firm*—Andrus, Sceales, Starke & Sawall

[57] ABSTRACT

An adjustment assembly for a throttle cam includes a mounting area on the throttle cam in which a hole is provided. A cam adjustment is provided which includes a base plate in a cylindrical shoulder extending from the base plate with the throttle cam being mounted on the shoulder. The shoulder is provided with an eccentrically located hole so that rotation of the cam adjustment results in both horizontal and vertical movement of the cam.

2 Claims, 1 Drawing Sheet

CAM ADJUSTMENT ASSEMBLY

BACKGROUND OF THE INVENTION

This invention relates to a cam adjustment assembly and more particularly to an assembly that allows for proper, vertical and horizontal alignment of a throttle cam with its associated pickup lever.

In a variety of marine propulsion units and in particular marine outboard engines, a pivoting throttle cam engages a throttle pickup lever and the movement of the throttle cam by a throttle link rod causes associated movement of the throttle pickup lever which in turn varies the throttle opening in the propulsion unit.

During assembly and/or timing adjustments it is necessary to align an indicator line on the throttle cam with the throttle cam follower on the throttle pickup lever.

In the past, this was done by removing the end of the throttle link rod from the throttle cam and then loosening the mounting means on the throttle cam and moving the throttle cam within an elongated horizontal mounting slot. In order to provide vertical adjustment for the throttle cam it was necessary to loosen the mounting of the carburetor on which the throttle cam was mounted and move the carburetor on its mounting screws. Thus, horizontal adjustment required the removal of the throttle link rod and vertical adjustment required actual movement of the carburetor.

The present invention provides a throttle cam adjustment assembly in which it is necessary only to loosen one mounting bolt. After loosening the mounting bolt, a cam adjuster is rotated and the eccentric shape of the cam adjuster allows for vertical and horizontal movement of the throttle cam.

Thus, the present invention greatly simplifies the procedure for adjusting both the vertical and horizontal position of the throttle cam.

SUMMARY OF THE INVENTION

An adjustment assembly for a throttle cam includes a mounting area on the throttle cam in which a hole is provided.

According to another aspect of the invention, a cam adjustment means is provided which includes a base plate and a cylindrical shoulder extending from the base plate with the throttle cam being mounted on the shoulder. The shoulder is provided with an eccentrically located hole so that rotation of the cam adjustment means results in eccentric movement of the throttle cam i.e., both horizontal and vertical movement.

In accordance with yet another aspect of the invention, the base plate of the cam adjustment means is provided with both flat surfaces for engagement and rotation of the cam adjustment means by tool and with frictionally enhanced surfaces about its circumference to facilitate manual rotation of the cam adjustment means.

BRIEF DESCRIPTION OF THE DRAWINGS

The drawings illustrate the best mode presently contemplated of carrying out the invention.

In the drawings.

DETAILED DESCRIPTION

Figure 1:
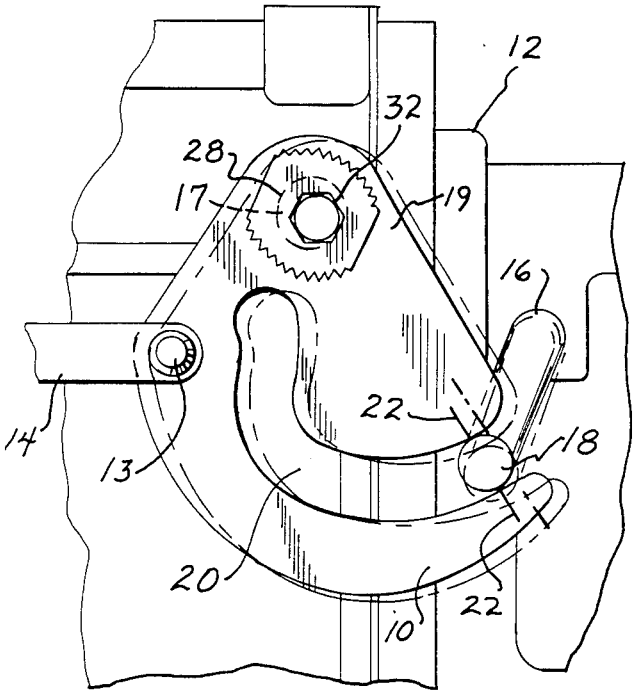
FIG. 1 is a side elevational view of a throttle cam and its associated throttle pickup lever with the throttle cam mounted on the cam adjuster of the present invention and with phantom lines indicating alternate positions.

As seen in FIG. 1, a throttle cam 10 is mounted on the casing of a carburetor 12. A throttle link rod 14 is connected to pin 13 on throttle cam 10 and translates movement of a throttle control (not shown) into pivotal movement of throttle cam 10. The pivotal movement of throttle cam 10 results in movement of throttle pickup lever 16 caused by the movement of roller 18 within the curved slot 20 of cam 10.

As throttle pickup lever 16 moves, the throttle opening within carburetor 12 is varied.

Figure 3:
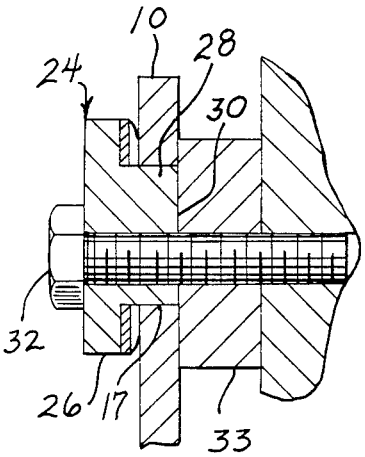
FIG. 3 is a sectional view taken along the line 3—3 in FIG. 2.
Figure 4:
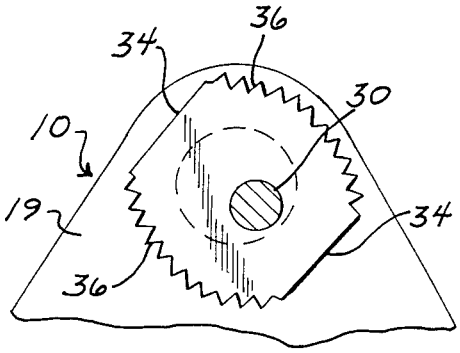
FIG. 4 is a front view of the cam adjuster.

During assembly and/or timing adjustments it is necessary to align etched indicator lines 22 with the approximate center of roller 18. This alignment assures proper timing between the spark advance and the throttle opening in the carburetor. In order to facilitate this alignment procedure, throttle cam 10 is provided with a hole 17 in upper mounting area 19 and is mounted on carburetor body 12 by means of a cam adjuster 24. Cam adjuster 24 includes a base portion 26 and a cylindrical shoulder 28 that extends outwardly from base 26 and includes an eccentrically located hole 30. A screw 32 or other mounting device is inserted through hole 30 and releasably secures throttle cam 10 and cam adjuster 24 to carburetor body 12. FIG. 3 also shows the use of a spacer 33. However, the use of such a device is not required by the invention.

Figure 2:
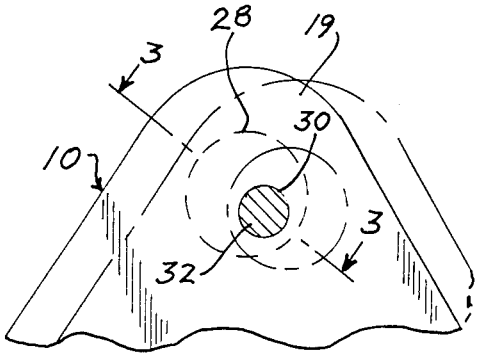
FIG. 2 is an enlarged side view of the mounting of the cam on the cam adjuster with phantom lines indicating an alternate position.

In order to vertically or horizontally adjust the position of throttle cam 10, screw 32 is loosened so as to allow rotational movement of cam adjuster 24. A tool such as a wrench can be applied to the flats 34 on the circumference of cam adjuster 24 or cam adjuster 24 can be rotated manually. To facilitate manual rotation of cam adjuster 24, a frictionally enhanced surface in the form of a series of serrations 36 is provided about the circumference of cam adjuster 24. Due to the eccentricity of the position of hole 30, rotational movement of cam adjuster 24 results in both a vertical and horizontal movement of throttle cam 10. Thus, the position of indicator lines 22 may be varied slightly in both a vertical and horizontal plane in order to bring them into proper alignment with the center of roller 18. The variation in position of cam adjuster 24 and the resulting variation in the position of throttle cam 10 is best shown in phantom in FIG. 2.

Thus, the vertical and horizontal position of throttle cam 10 and its associated indicator lines 22 may be adjusted by merely loosening screw 32 and rotating cam adjuster 24.

It is recognized that various alternatives and modification are possible in the scope of the appended claims.

I claim:

1. A cam adjustment to provide proper vertical and horizontal alignment between a throttle cam and its associated pickup lever where the throttle cam is pivotally mounted to a stationary structure by means of a hole disposed in the throttle cam, said adjustment comprising:

rotatable cam adjustment means disposed within the cam hole and providing an eccentric surface on which the throttle cam hole rides, said cam adjustment means comprising, a base plate provided with at least a pair of flat surfaces about its circumference for engagement by a tool for rotation of the cam adjustment means, a cylindrical shoulder extending from said base plate and having a diameter substantially equal to that of the cam hole the throttle cam being mounted on said shoulder with said shoulder provided with an eccentrically located hole, mounting means for releasably securing the throttle cam to an adjacent stationary structure, said mounting means passing through said eccentrically located hole.

2. The cam adjustment assembly of claim 1 wherein said base plate is provided with a frictionally enhanced surface along its circumference to facilitate manual rotation of said cam adjustment means.

* * * * *